US008395580B2

(12) United States Patent
Miyazaki

(10) Patent No.: US 8,395,580 B2
(45) Date of Patent: Mar. 12, 2013

(54) METHOD FOR DRIVING ELECTROPHORESIS DISPLAY DEVICE, ELECTROPHORESIS DISPLAY DEVICE, AND ELECTRONIC APPARATUS

(75) Inventor: Atsushi Miyazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 999 days.

(21) Appl. No.: 12/180,375

(22) Filed: Jul. 25, 2008

(65) Prior Publication Data

US 2009/0058798 A1 Mar. 5, 2009

(30) Foreign Application Priority Data

Aug. 31, 2007 (JP) ..... 2007-226474

(51) Int. Cl.
*G09G 3/34* (2006.01)

(52) U.S. Cl. ..... 345/107; 345/208; 345/209

(58) Field of Classification Search ..... 345/97, 345/107; 349/167
See application file for complete search history.

(56) References Cited

U.S. PATENT DOCUMENTS

| | | | | |
|---|---|---|---|---|
| 6,600,473 | B1 * | 7/2003 | Kobayashi et al. | 345/97 |
| 7,542,024 | B2 | 6/2009 | Koyama | |
| 2004/0145696 | A1 * | 7/2004 | Oue et al. | 349/167 |
| 2006/0262083 | A1 * | 11/2006 | Zhou et al. | 345/107 |
| 2008/0143668 | A1 * | 6/2008 | Shin et al. | 345/107 |
| 2009/0251456 | A1 | 10/2009 | Koyama | |

FOREIGN PATENT DOCUMENTS

| | | | |
|---|---|---|---|
| JP | 2002-149115 | | 5/2002 |
| JP | 2002149115 | A * | 5/2002 |
| JP | 2003-084314 | A | 3/2003 |
| JP | 2005-275212 | A | 10/2005 |
| JP | 2006-267982 | | 10/2006 |
| JP | 2007-316594 | | 12/2007 |

* cited by examiner

*Primary Examiner* — Quan-Zhen Wang
*Assistant Examiner* — Troy Dalrymple
(74) *Attorney, Agent, or Firm* — AdvantEdge Law Group, LLC

(57) ABSTRACT

There is provided a method for driving an electrophoresis display device equipped with a plurality of pixel electrodes, each of the pixel electrode being provided for every pixel, a common electrode provided to oppose the plurality of pixel electrodes, and an electrophoresis element containing electrophoresis particles, the electrophoresis element being sandwiched by the plurality of pixel electrodes and the common electrode. The method includes driving the electrophoresis element and updating a display by a common voltage swing drive method in which a rectangular wave in which a first potential and a second potential are repeated is applied to the common electrode for not less than one cycle during a display update time in which the first potential or the second potential for moving the electrophoresis particles is applied to each of the pixel electrodes. A frequency of the rectangular wave is not less than 20 Hz.

12 Claims, 13 Drawing Sheets

METHOD FOR DRIVING ELECTROPHORESIS DISPLAY DEVICE, ELECTROPHORESIS DISPLAY DEVICE, AND ELECTRONIC APPARATUS

BACKGROUND

1. Technical Field

The present invention relates to a method for driving an electrophoresis display device, an electrophoresis display device, and an electronic apparatus.

2. Related Art

A phenomenon (electrophoresis phenomenon) in which electrophoresis particles are moved by coulomb forces has been known, and an electrophoresis display device using the phenomenon has been developed.

The electrophoresis display device is equipped with a pixel electrode provided in each of a plurality of pixels, a common electrode provided to oppose the plurality of pixel electrodes, and an electrophoresis element that is sandwiched by the plurality of pixel electrodes and the common electrode and that contains electrophoresis particles. The electrophoresis display device performs a display drive by moving the electrophoresis particles by an electrical field occurred by a potential difference between the pixel electrodes and the common electrode.

For example, in JP-A-2002-149115, there is a description about "common voltage swing drive method" for performing update of display by switching the potential of each pixel electrode by using two types of potentials having a relationship of high and low and by also switching the potential of the common electrode by the two types of potentials.

Herein, the common voltage swing drive method will be described with reference to FIG. 16 and FIGS. 17A to 17C.

FIG. 16 is a diagram showing an example of a drive timing chart according to a conventional electrophoresis display device. FIGS. 17A to 17C are diagrams showing a behavior of black particles (electrophoresis particles) 1026 and white particles (electrophoresis particles) 1027 when driven in accordance with the timing chart of FIG. 16. Note that in FIGS. 17A to 17C, the black particles 1026 and the white particles 1027 are fully agitated and an image is to be displayed from a display state with gray.

In FIG. 16 and FIGS. 17A to 17C, a plurality of pixels 1040 are separated into a pixel 1040*b* for displaying black and a pixel 1040*w* for displaying white for description.

During a display update time tx of FIG. 16, a high potential (first potential; H) is input to a pixel electrode 1035*b* of the pixel 1040*b*, and a low potential (second potential; L) is input to a pixel electrode 1035*w* of the pixel 1040*w*.

The display update time tx is about 2 to 2.5 sec as is different depending on the property of the electrophoresis element. In FIG. 16, the display update time tx is set to 2.0 sec.

A rectangular wave whose cycle is 200 to 500 ms is input to a common electrode 1037. In FIG. 16, a rectangular wave whose cycle is 40 ms (2.5 Hz) in which a high potential time of 200 ms and a low potential time of 200 ms are repeated is input during the display update time tx. That is, during the display update time tx, the rectangular wave is input for five cycles.

Note that the "common voltage swing drive method" in the invention refers to a driving method in which a rectangular wave in which the high potential time and low potential time are repeated is applied to the common electrode 1037 for at least not less than one cycle during the display update time tx.

Next, a behavior of the black particles 1026 and the white particles 1027 when driven based on the timing chart of FIG. 16 will be described with reference to FIGS. 17A to 17C.

First, as shown in FIG. 17A, when the high potential (H) is input to the common electrode 1037, a potential difference occurs between the pixel electrode 1035*w* to which the low potential (L) is input and the common electrode 1037 in the pixel 1040*w*, and the white particles 1027 move to the side of the common electrode 1037 and the black particles move to the side of the pixel electrode 1035*w*.

On the other hand, in the pixel 1040*b*, no potential difference occurs between the pixel electrode 1035*b* to which the high potential (H) is input and the common electrode 1037. Accordingly, the black particles 1026 and the white particles 1027 do not move.

Next, as shown in FIG. 17B, when the low potential (L) is input to the common electrode 1037, no potential difference occurs between the pixel electrode 1035*w* to which the low potential (L) is input and the common electrode 1037, so that the black particles 1026 and the white particles 10127 do not move.

On the other hand, in the pixel 1040*b*, a potential difference occurs between the pixel electrode 1035*b* to which the high potential (H) is input and the common electrode 1037, and the black particles 1026 move the side of the common electrode 1037 and the white particles move the side of the pixel electrode 1035*b*.

The behavior when the first one cycle of the rectangular wave in FIG. 16 is applied to the common electrode 1037 is schematically shown in FIGS. 17A and 17B. The rectangular wave whose cycle is one rotation of the high potential (H) and the low potential (L) is further input to the common electrode 1037 for four cycles.

FIG. 17C shows a state right after the potential corresponding to five cycles containing the cycle of the aforementioned FIGS. 17A and 17B is applied. That is, FIG. 17C shows a state of each electrophoresis particles when the display update time tx is finished. The white particles 1027 are gathered at the side of the common electrode 1037 of the pixel 1040*w* and white is displayed, and the black particles 1026 are gathered at the side of the common electrode 1037 of the pixel 1040*b* and black is displayed.

According to the common voltage swing drive method, the potential applied to the pixel electrode 1035 and the common electrode 1037 can be controlled by two values of the high potential (H) and the low potential (L). Accordingly, the voltage to be applied can be lowered a circuit structure can be simplified. Further, when a TFT (Thin Film Transistor) is used as a switching element of each pixel electrode 1035, there is a merit that the reliability of the TFT can be assured by a low voltage drive.

However, there is a problem described below in this method. There is a case that the potential input to the pixel electrode 1035 the common electrode 1037 is different from a predetermined voltage due to a current leak from a pixel circuit connected to the pixel electrode 1035, a resistance generated when an element substrate equipped with the pixel electrode and the common electrode provided to oppose the element substrate are electrically connected, a resistance owned by the common electrode 37, or the like.

Accordingly, a potential difference occurs in the pixel in which no potential different should fundamentally occur and the electrophoresis particles may be flown back. As a result, there was a problem in that a phenomenon called flicker was generated. The electrophoresis particles are separated from the electrode and the contrast of a display image is temporally deteriorated by the flicker.

The flicker generated in the conventional common voltage swing drive method will be described with reference to FIG. 18. FIG. 18 is a graph showing reflectance measured in chronological order when the pixel 1040*w* is displayed with white.

In FIG. 18, the horizontal axis shows elapsed time, and driving based on the timing chart of FIG. 16 is performed during the display update time tx that starts from the timing of about two sec, and thereafter, the display retention time th continues. Note that, the timing of about two sec when the display update time tx is started shows a starting pint of the measurement and the display retention time tx shows a data retention time at the measurement, and there is no other intention in each thereof.

The longitudinal axis shows reflectance when the pixel 1040*w* is displayed with white and observed from the side of the common electrode 1037. Note that the reflectance does not reach 50% when the display update time tx is passed. This is caused by display property of the electrophoresis element. The reflectance of the electrophoresis element to a standard white reflection plate is generally about 50% although different depending on the spec.

In FIG. 18, the area surrounded by the ○ of the graph at a lower portion shows a timing at which a first cycle of the rectangular wave is applied.

As shown in FIG. 17B, the low potential (L) is applied to the common electrode 1037 and the pixel electrode 1035*w* in pixel 1040*w* that displays white at the timing, so that no potential difference occurs and each electrophoresis particles are supposed to remain in the position. However, as shown in the ○ in the graph, the reflectance is lowered in reality. This is caused by a potential difference due to the aforementioned current leak or the like and shows that flicker is generated by flow back of the electrophoresis particles.

Further, the flicker generates not only in the first cycle, but also in the second cycle shown by the □ although the level of flicker is reduced. Further, the flicker also generates a little in the third to fifth cycles.

The flickers of the levels can be recognized by a person. Accordingly, the user of the electrophoresis display device suffers from a visual stress due to the flicker.

SUMMARY

An advantage of some aspects of the invention is to provide a method for driving an electrophoresis display device superior in display quality, and to provide an electrophoresis display device and an electronic apparatus superior in display quality.

According to an aspect of the invention, there is provided a method for driving an electrophoresis display device equipped with a pixel electrode that is provided for a pixel, a common electrode provided to oppose the pixel electrode, and an electrophoresis element containing electrophoresis particles, the electrophoresis element being sandwiched by the pixel electrode and the common electrode. The method for driving an electrophoresis display device includes driving the electrophoresis element and updating a display by a common voltage swing drive method in which a rectangular wave in which a first potential and a second potential are repeated is applied to the common electrode for not less than one cycle during a display update time in which the first potential or the second potential for moving the electrophoresis particles is applied to the pixel electrode. A frequency of the rectangular wave is not less than 20 Hz.

Herewith, even when lowering of reflectance is occurred, the lowering occurs within a time that is too short to be recognized. Accordingly, a driving method of an electrophoresis display device that does not give a visual stress to the user and that is superior in display quality can be provided.

It is preferable that a period during applying the first potential and a period during applying the second potential in the rectangular wave are not less than 1 ms and not more than 25 ms.

Herewith, if the period during applying the first potential and the period during applying the second potential are not less than 1 ms, a momentum necessary for updating the display can be provided to the electrophoresis particles. Accordingly, responsiveness can be maintained. Further, if the period during applying the first potential and the period during applying the second potential are not more than 25 ms, lowering of reflectance is hardly recognized, so that display quality can be improved. Accordingly, a driving method of an electrophoresis display device having both responsiveness and display quality can be provided.

It is more preferable that a period during applying the first potential and a period during applying the second potential in the rectangular wave are not less than 5 ms and not more than 20 ms.

Herewith, if the period during applying the first potential and the period during applying the second potential are not less than 5 ms, a momentum necessary for updating the display can be provided to the electrophoresis particles. Accordingly, responsiveness can be improved. Further, if the period during applying the first potential and the period during applying the second potential are not more than 20 ms, lowering of reflectance becomes further difficult to be recognized, so that display quality can be further improved. Accordingly, a driving method of an electrophoresis display device in which both responsiveness and display quality are further improved can be provided.

According to another aspect of the invention, there is provided an electrophoresis display device including at least a pixel electrode that is provided for a pixel, a common electrode provided to oppose the pixel electrode, and an electrophoresis element containing electrophoresis particles, the electrophoresis element being sandwiched by the pixel electrode and the common electrode. Driving of the electrophoresis element for updating a display is performed by a common voltage swing drive method in which a rectangular wave in which a first potential and a second potential are repeated is applied to the common electrode for not less than one cycle during a display update time in which the first potential or the second potential for moving the electrophoresis particles is applied to the pixel electrode, and a control unit for controlling a frequency of the rectangular wave so as to be not less than 20 Hz is included.

Herewith, even when lowering of reflectance is occurred, the lowering occurs within a time that is too short to be recognized. Accordingly, an electrophoresis display device that does not give a visual stress to the user and that is superior in display quality can be provided.

It is preferable that the control unit controls a period during applying the first potential and a period during applying the second potential in the rectangular wave so as to be not less than 1 ms and not more than 25 ms.

Herewith, if the period during applying the first potential and the period during applying the second potential are not less than 1 ms, a momentum necessary for updating the display can be provided to the electrophoresis particles. Accordingly, responsiveness can be maintained. Further, if the period during applying the first potential and the period during applying the second potential are not more than 25 ms, lowering of reflectance is hardly recognized, so that display quality can be improved. Accordingly, an electrophoresis display device having both responsiveness and display quality can be provided.

It is more preferable that the control unit controls a period during applying the first potential and a period during applying the second potential in the rectangular wave so as to be not less than 5 ms and not more than 20 ms.

Herewith, if the period during applying the first potential and the period during applying the second potential are not less than 5 ms, a momentum necessary for updating the display can be provided to the electrophoresis particles. Accordingly, responsiveness can be improved. Further, if the period during applying the first potential and the period during applying the second potential are not more than 20 ms, lowering of reflectance is hardly recognized, so that display quality can be improved. Accordingly, an electrophoresis display device having both responsiveness and display quality can be provided.

It is preferable that the pixel is equipped with a pixel circuit, and the control unit employs an active matrix method for controlling the pixel via the pixel circuit.

Herewith, the driving can be separately performed for every pixel. Accordingly, an electrophoresis display device capable of displaying at a high resolution and with flexibility can be provided.

It is preferable that the pixel circuit is equipped with a storage device.

Herewith, the potential of the pixel electrode can be kept at a constant value during the display update time. Accordingly, an electrophoresis display device by which uniform contrast display can be obtained can be provided.

According to still another aspect of the invention, there is provided an electronic apparatus equipped with the electrophoresis display device according to the another aspect of the invention.

Herewith, even when lowering of reflectance is occurred, the lowering occurs within a time that is too short to be recognized. Accordingly, an electronic apparatus that does not give a visual stress to the user and that is superior in display quality can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Electrophoresis Display Device

Figure 1:
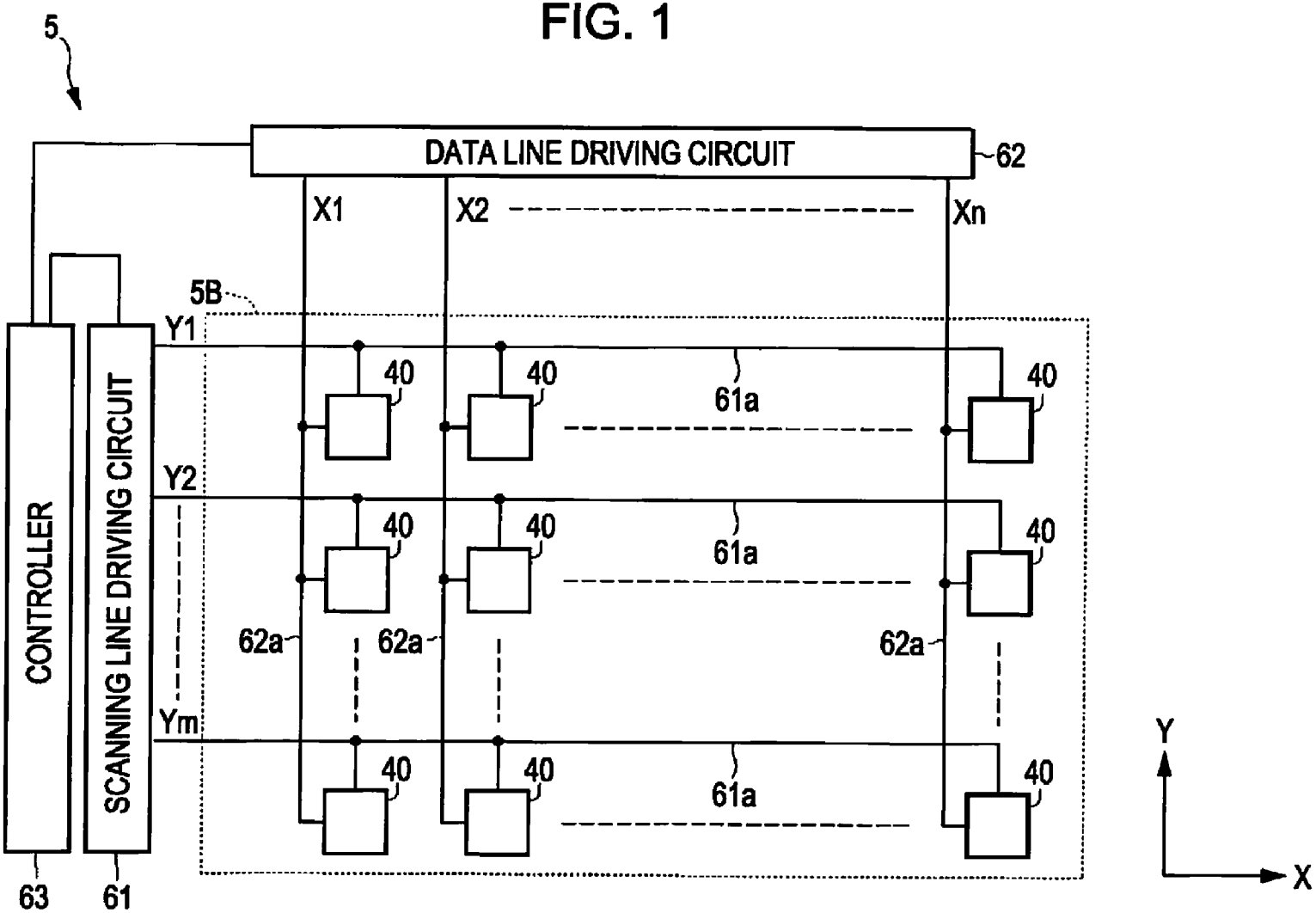
FIG. 1 is a plan view schematically showing an electrophoresis display device.

Hereinafter, an electrophoresis display device of the invention will be described with reference to the accompanying drawings.

The embodiment shows an aspect of the invention and does not restrict the invention, and any modification can be made within the scope of the technical ideas of the invention. Further, in the drawings described below, the scale size, number, or the like of each element are different from those of the real element in order to provide clear visibility.

FIG. 1 is a plan view schematically showing an electrophoresis display device 5 of an active matrix driving method. The electrophoresis display device 5 is equipped with a display area 5B, a scanning line driving circuit (control unit) 61, a data line driving circuit (control unit) 62, and a controller (control unit) 63 around the area of the display area 5B. A plurality of scanning lines 61*a* is extended to the display area 5B from the scanning line driving circuit 61 and a plurality of data lines 62*a* is extended to the display are 5B from the data lined driving circuit 62. The scanning line driving circuit 61 and the data line driving circuit 62 are electrically connected to the controller 63. Pixels 40 are arranged in a matrix manner along the extending direction (X axis direction) of the scanning line 61 and the extending direction (−Y axis direction) of the data line 62*a*.

Figure 2:
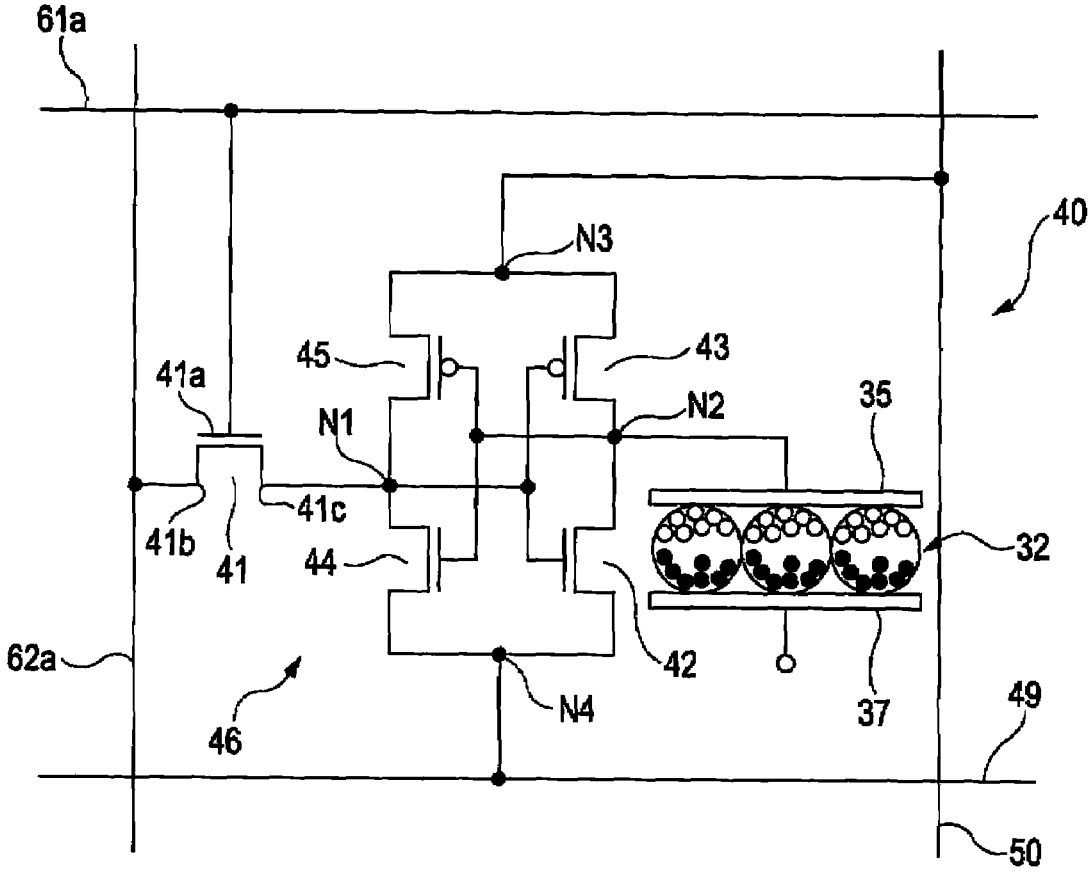
FIG. 2 is a diagram showing a circuit configuration of a pixel.

FIG. 2 is a diagram showing a circuit configuration of the pixel 40. As shown in FIG. 2, the pixel 40 is equipped with a switching element (pixel circuit) 41, a latch circuit (storage device) 46, an electrophoresis element 32, a pixel electrode 35, and a common electrode 37. The scanning line 61*a*, the data line 62*a*, a low potential power source line 49, and a high potential power source line 50 are provided to surround the elements.

The switching element 41 is an n-channel transistor of a field effect type, and the scanning line 61*a* is electrically connected to a gate 41*a* and the data line 62*a* is electrically connected to a terminal 41*b*. The latch circuit 46 is provided between the switching element 41 and the pixel electrode 35. Power source of the latch circuit 46 is provided by the low potential power source line 49 and the high potential power source line 50. An input terminal N1 of the latch circuit 46 is connected to a terminal 41*c* of the switching element 41, and an output terminal N2 of the latch circuit 46 is connected to the pixel electrode 35.

Note that a low potential (L) is supplied to the low potential power source line 49 and a high voltage (H) is provided to the high potential power source line 50 when the control unit is in an operation state.

The latch circuit 46 is constituted by the combination of an inverter circuit formed by a p-channel transistor 43 and an n-channel transistor 42, and an inverter circuit formed by a p-channel transistor 45 and an n-channel transistor 44.

In the latch circuit 46, the p-channel transistor 45 and the n-channel transistor 44 are connected at the input terminal N1, and the p-channel transistor 43 and the n-channel transistor 42 are connected at the output terminal N2.

The gates of the p-channel transistor 45 and the n-channel transistor 44 are connected to the output terminal N2 and the pixel electrode 35, and the gates of the p-channel transistor 43 the n-channel transistor 42 are connected to the input terminal N1 and the switching element 41.

The p-channel transistors 43, 45 are connected to the high potential power source line 50 and the n-channel transistors 42, 44 are connected to the low potential power source line 49.

The latch circuit 46 having such a structure outputs the low potential from the output terminal N2 when the input terminal N1 is in the high potential and outputs the high potential from the output terminal N2 when the input terminal N1 is in the low potential. Further, the output potential of the latch circuit 46 is kept till the power source of the latch circuit 46 is turned off, so that a stable potential is input to the pixel electrode 35 connected to the output terminal N2.

Figure 3:
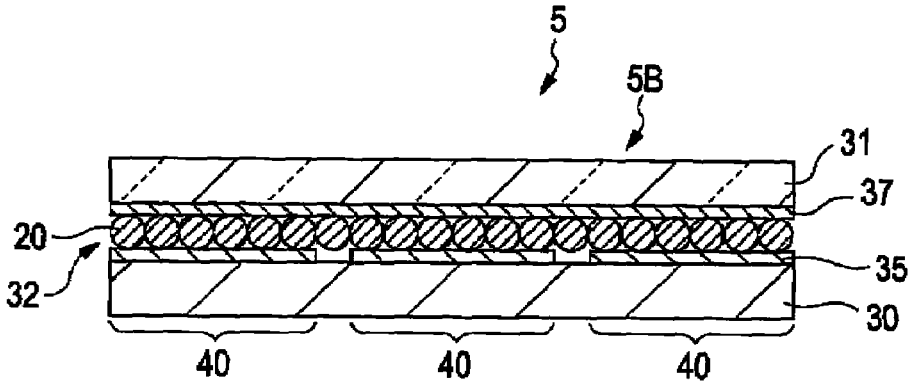
FIG. 3 is a partial cross sectional view showing a display area.

FIG. 3 is a partial cross sectional view showing the display area 5B. The electrophoresis display device 5 has a structure in which the electrophoresis element 32 is sandwiched between an element substrate 30 and a counter substrate 31. The electrophoresis element 32 has a structure in which a plurality of microcapsules 20 is arranged in plan view.

A plurality of pixel electrode 35 are formed to correspond to the pixels 40 on the element substrate 30. The element substrate 30 is made of a glass, plastic, or the like. As is omitted in FIG. 3, the scanning line 61*a*, the data line 62*a*, the switching element 41, the latch circuit 46, and the like shown in FIGS. 1, 2 are formed between the element substrate 30 and the pixel electrodes 35.

The counter substrate 31 is positioned at the side at which an image is displayed in the electrophoresis display device 5 and is a transparent substrate made of a glass, plastic, or the like. The common electrode 37 is formed on approximately the entire surface of the counter substrate 31 at the side of the electrophoresis element 32. The common electrode 37 is made of a transparent conductive material such as, for example, MgAg (magnesium silver), ITO (indium tin oxide), and IZO (indium zinc oxide).

Figure 4:
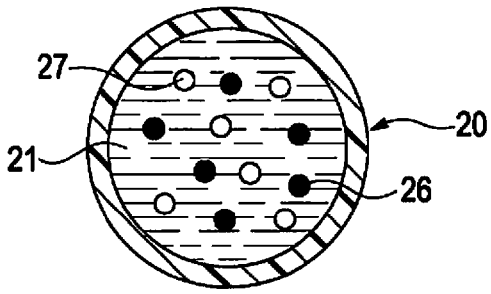
FIG. 4 is a cross sectional view schematically showing a microcapsule.

FIG. 4 is a cross sectional view schematically showing a microcapsule 20. The microcapsule 20 has a particle diameter of, for example, about 50 μm. The microcapsule 20 is a round body containing a disperse medium 21, a plurality of black particles (electrophoresis particles), and a plurality of white particles (electrophoresis particles) 27.

As for the material of the shell region of the microcapsule 20, an acrylate resin such as poly methyl methacrylate, poly ethyl methacrylate, or the like, an urea resin, a polymer resin having translucency such as gelatine may be employed. The microcapsules 20 are sandwiched by the common electrode 37 and the pixel electrodes 35 as shown in FIG. 3, and one or a plurality of microcapsules 20 is disposed in one pixel 40.

The disperse medium 21 is a liquid that disperses the black particles 26 and the white particles 27 in the microcapsule 20. As for the material of the disperse medium 21, for example, the one may be employed in which a surface active agent is blended in water, alcohol system solvent such as methanol, ethanol, isopropanol, butanol, octanol, methyl cellosolve, or the like, esters such as ethyl acetate, butyl acetate, or the like, ketones such as acetone, methyl ethyl ketone, methyl isobutyl ketone, or the like, aliphatic hydrocarbon such as pentane, hexane, octane, or the like, alicyclic hydrocarbon such as cyclohexane, methylcyclohexane, or the like, aromatic hydrocarbon such as a kind of benzene having long-chain alkyl group such as benzene, toluene, xylene, hexylbenzene, hebutylbenzene, octyl benzene, nonyl benzene, decylbenzene, undecyl benzene, dodecylbenzene, tridecylbenzene, tetradecylbenzene, or the like, halogenated hydrocarbon such as methylene chloride, chloroform, carbon tetrachloride, 1,2-dichloroethane, or the like, carboxylic salt, various other oils, or the like or a blended material thereof.

The black particle 26 is a particle (polymer or an inorganic material) made of a black pigment such as, for example, aniline black, carbon black, or the like and for example, charged to positive polarity.

The white particle 27 is a particle (polymer or an inorganic material) made of a white pigment such as, for example, titanium dioxide, zinc flower, antimonous oxide, or the like, and for example, charged to negative polarity.

A charge control agent made of particles such as an electrolyte, a surface active agent, a metal soap, a resin, a gum, an oil, a varnish, a compound, or the like, a dispersant such as a titanium series coupling agent, an aluminum series coupling agent, a silane series coupling agent, or the like, a lubricant agent, a stabilizing agent, or the like can be added to the pigment constituting the particles as necessary.

Driving Method of the Electrophoresis Display Device

Next, a driving method of the electrophoresis display device 5 of the invention will be described.

Figure 5:
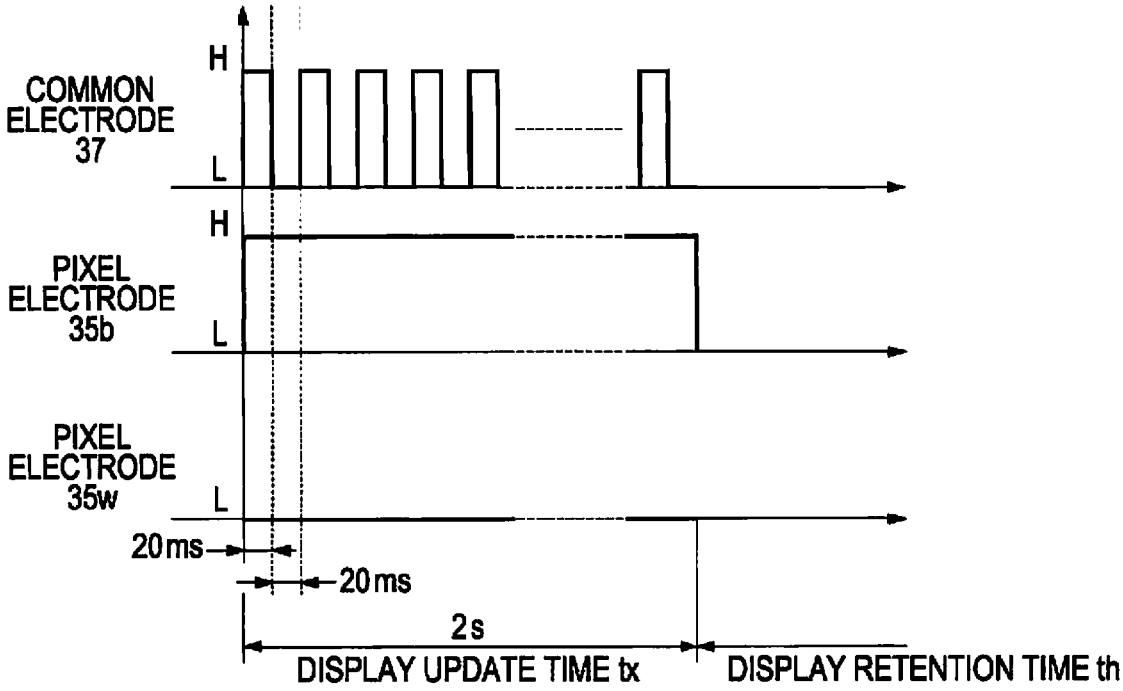
FIG. 5 is a diagram showing a timing chart according to the electrophoresis display device.
Figure 6A:
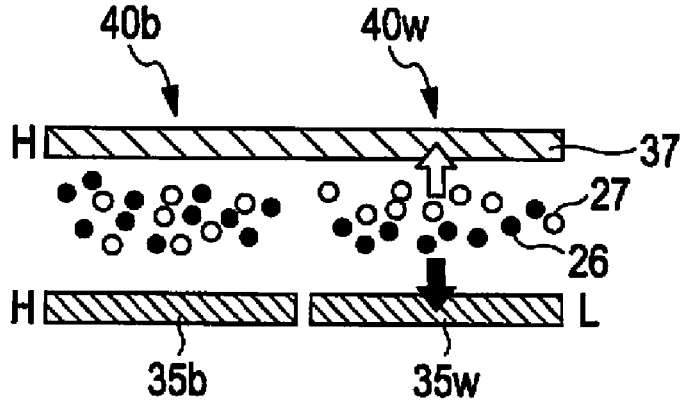
FIGS. 6A to 6C are diagrams showing a behavior of electrophoresis particles.
Figure 6B:
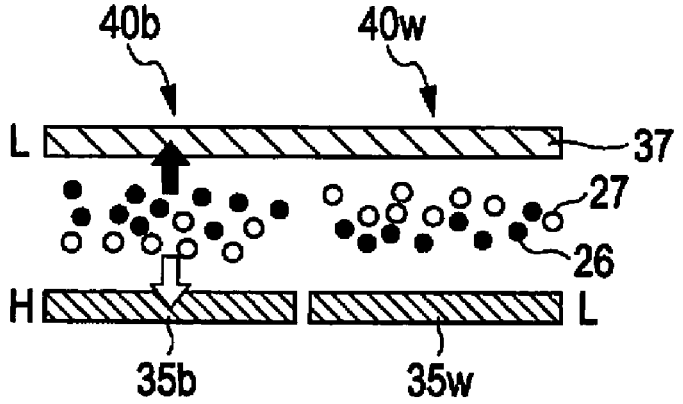
Figure 6C:
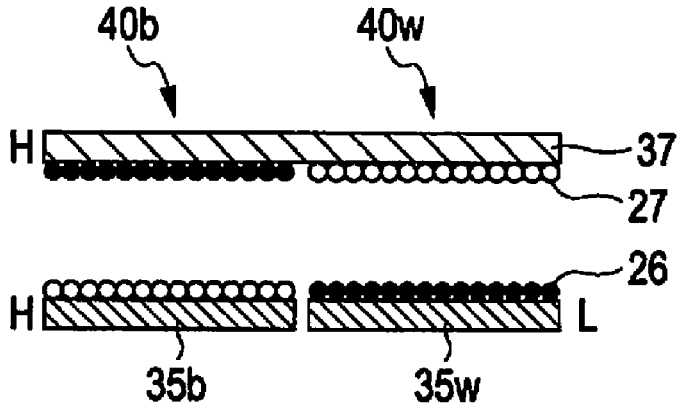

FIG. 5 is a diagram showing a timing chart according to the electrophoresis display device 5 of the invention. FIGS. 6A to 6*c* are diagram showing a behavior of the black particles (electrophoresis particles) 26 and the white particles (electrophoresis particles) 27.

The plurality of pixels 40 are separated into the pixel 40*b* for displaying black and pixel 40*w* for displaying white for description in FIGS. 5, 6A to 6C.

A high potential (first potential; H) is input to the pixel electrode 35*b* of the pixel 40*b* and a low potential (second potential; L) is input to the pixel electrode 35*w* of the pixel 40*w* in a display update time tx of FIG. 5.

Further, a rectangular wave whose cycle is 40 ms in which a high potential time of 20 ms and a low potential time of 20 ms are repeated is input to the common electrode 37. That is a rectangular wave whose frequency is 25 Hz (40 ms cycle) is input to the common electrode 37.

Further in the embodiment, the display update time tx is set to 2.0 sec. Accordingly, a rectangular wave whose cycle is 40 ms is repeated for 50 cycles in the display update time tx.

Note that the display update time tx is not limited to 2.0 sec and may be appropriately set between about 0.5 sec to 3.0 sec to match the spec. Further, in a display retention time th after the display update time tx, the low potential (L) is input to each of the pixel electrode 35*b*, the pixel electrode 35*w*, and the common electrode 37 and no potential difference occurs between each pixel electrode 35*b*, 35*w* and the common electrode 37, so that display is retained.

FIGS. 6A to 6C are diagrams showing a behavior of the black particles 26 and the white particles 27 at this time.

First, as shown in FIG. 6A, when the high potential (H) is input to the common electrode 37, a potential difference occurs between the pixel electrode 35*w* to which the low potential (L) is input and the common electrode 37 in the pixel 40*w*, and the white particles 27 move to the side of the common electrode 37 and the black particles 26 move to the side of the pixel electrode 35*w*.

On the other hand, in the pixel 40*b*, no potential difference occurs between the pixel electrode 35*b* to which the high potential (H) is input and the common electrode 37, so that the balk particles 26 and the white particles 27 do not move.

Next, as shown in FIG. 6B, when the low potential (L) is input to the common electrode 37, no potential difference occurs between the pixel electrode 35*w* to which the low potential (L) is input and the common electrode 37, so that the black particles 26 and the white particles 27 do not move.

On the other hand, a potential difference occurs between the pixel electrode 35*b* to which the high potential (H) is input and the common electrode 37 and the black particles 26 move to the side of the common electrode 37 and the white particles 27 move to the side of the pixel electrode 35*b*.

FIG. 6A and FIG. 6B schematically show a behavior of the particles corresponding to the initial one cycle of the rectangular wave applied the common electrode 37 in FIG. 5. 49 cycles of the rectangular wave whose cycle is constituted by the high potential (H) and the low potential (L) is further input to the common electrode 37.

FIG. 6C shows the state when 50 cycles of the potential containing the cycle of FIG. 6A and FIG. 6B is applied. That is, FIG. 6C shows a state of each electrophoresis particles at the time when the display update time tx is finished. The white particles 27 are gathered at the side of the common electrode 37 of the pixel 40*w* and white is displayed, and the black particles 26 are gathered at the side of the common electrode 37 of the pixel 40*b* and black is displayed.

Figure 7:
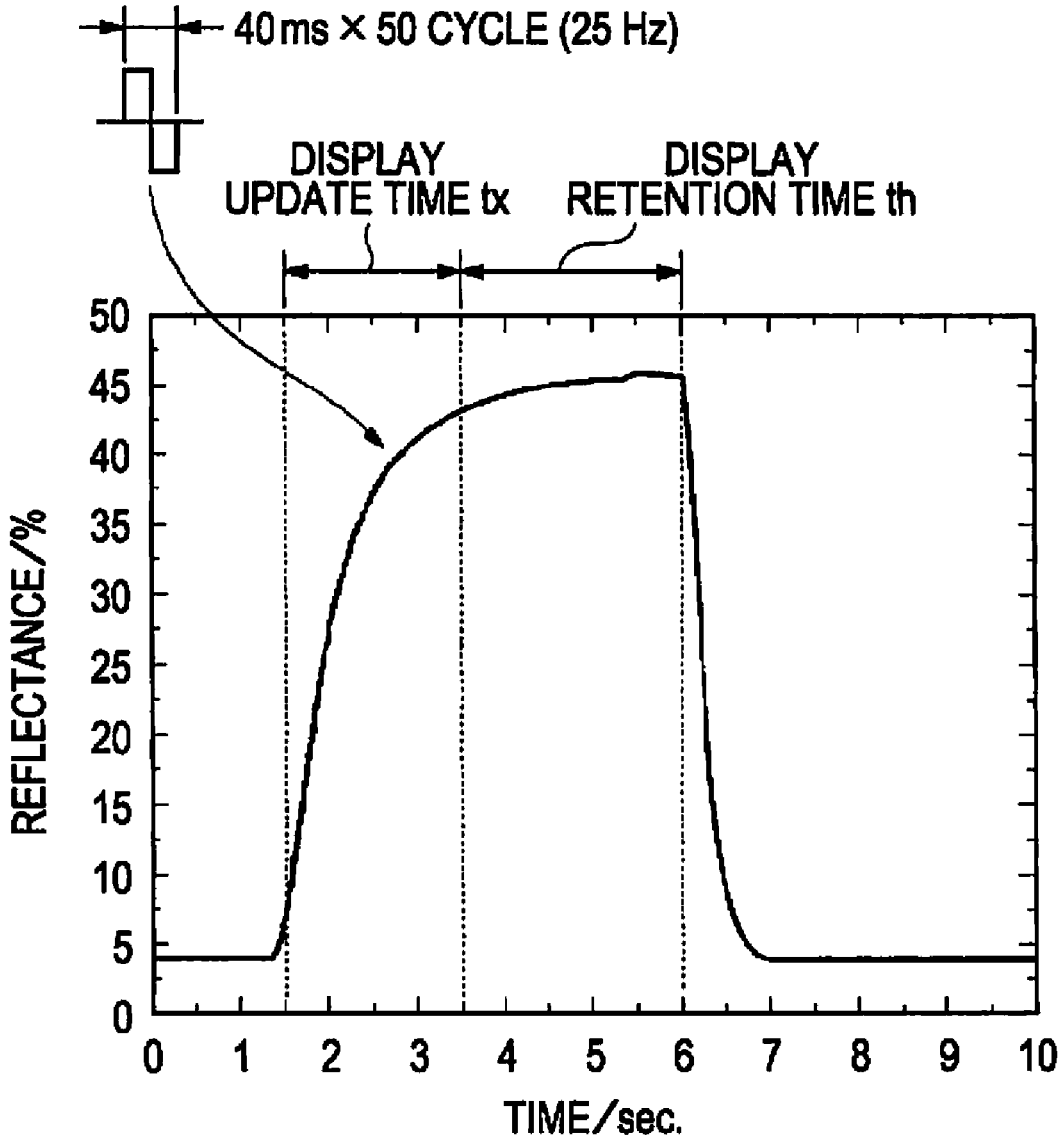
FIG. 7 is a diagram showing a graph in which reflectance is measured in chronological order.

Next, FIG. 7 is a graph showing reflectance in chronological order when the pixel 40*w* is displayed with white. In FIG. 7, the horizontal axis shows elapsed time. Driving based on the timing chart of FIG. 5 is performed during the display update time tx that starts from the timing of about 1.5 sec, and thereafter the display retention time th continues. Note that, the timing of about 1.5 sec when the display update time tx is started shows a starting pint of the measurement and the display retention time tx shows a data retention time at the measurement, and there is no other intention in each thereof.

As shown in FIG. 7, when the reflectance is rapidly increased during the display update time tx and thereafter transits to the display retention time th, the increase rate of the reflectance becomes moderate and the reflectance comes close to a fixed value.

In the embodiment, a rectangular wave whose frequency is 25 Hz (40 ms cycle) is input to the common electrode 37. Also in the electrophoresis display device 5 of the embodiment, during the low potential time in which no potential different should occur, a potential difference occurs due to a current leak from a pixel circuit such as the latch circuit 46 connected to the pixel electrode 35, a resistance generated when the element substrate 30 supporting the pixel electrode 35 sandwiching the electrophoresis element 32 and the counter substrate 31 supporting the common electrode 37 are electrically connected, a resistance owned by the common electrode 37, or the like. This causes an adverse current of the electrophoresis particles. However, the frequency of the common electrode potential is higher than that in the conventional electrophoresis display device, so that the period when reflectance is lowered due to the adverse current is one-tenth of the conventional period, and the period is in a level that makes the user difficult to recognize the lowering.

Figure 18:
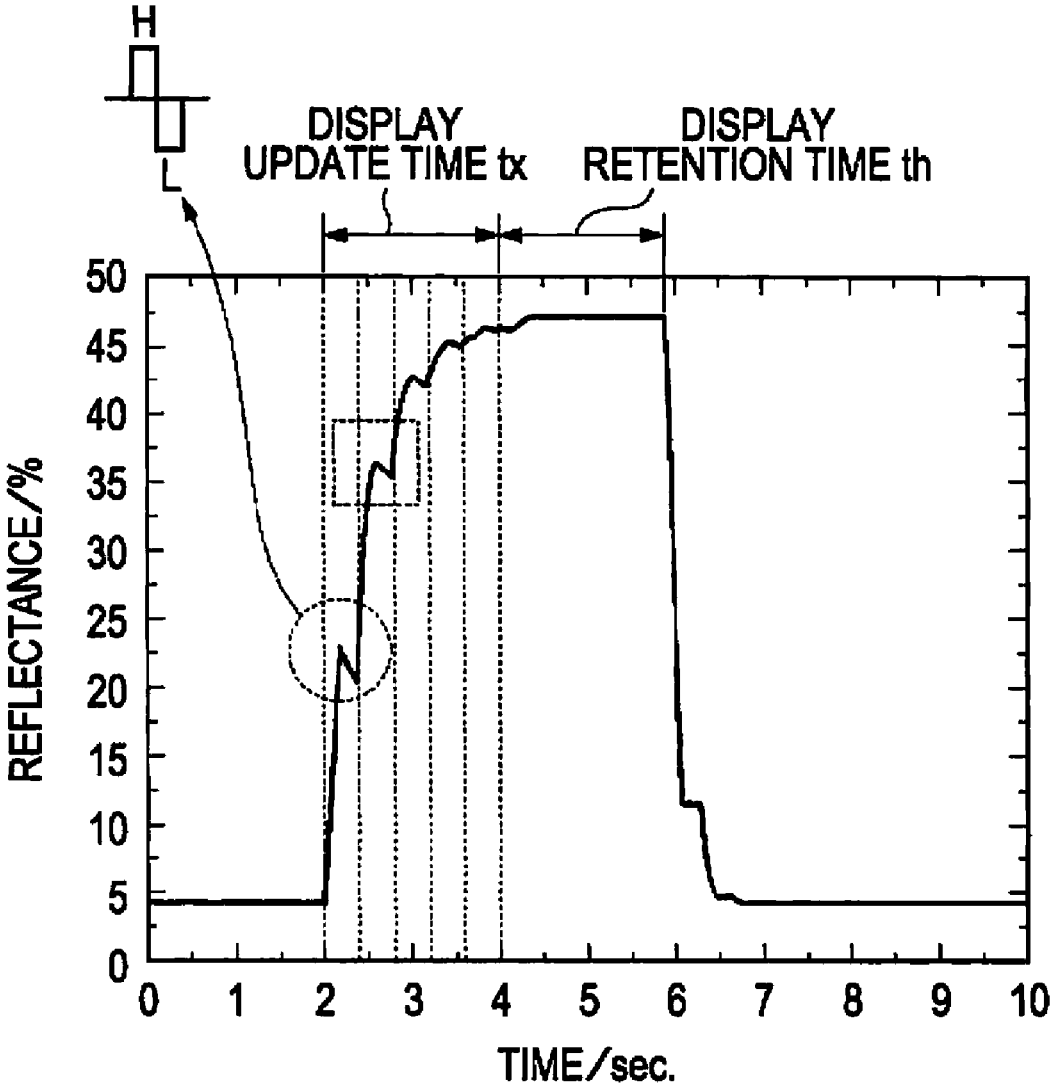
FIG. 18 is a diagram showing a graph in which reflectance is measured in chronological order.

Further, in the embodiment, the variation of the reflectance for every one cycle of the rectangular wave is smaller than that in the conventional one shown in FIG. 18. Specifically, the lowering of the reflectance observed in the conventional electrophoresis display device is about 3%. However, the lowering of the reflectance in the embodiment is not more than 0.5%. Also in this point, the lowering of the reflectance due to the adverse current is difficult to be recognized.

According to the electrophoresis display device 5 using such a driving method, effects described below can be obtained.

Display by the electrophoresis element 32 can be updated so that flicker does not outstand by inputting a rectangular wave whose frequency is not less than 25 Hz (not more than 40 ms cycle) to the common electrode 37. Accordingly, a high quality display by which the user does not feel visual stress when updating display can be provided.

That is, by setting the high potential time and the low potential time respectively to 20 ms during the display update time tx, a sufficient energy for moving each electrophoresis particle can be supplied and it becomes possible to prevent the flicker to outstand.

Accordingly, a high quality display by which the user does not feel visual stress when updating display can be provided.

Further, in the above embodiment, the description is made when the frequency of the rectangular wave is 25 Hz (40 ms cycle). However according to results of experiments performed by the inventor, it has been confirmed that the similar effect can be obtained if the frequency of the rectangular wave is not less than 20 Hz (50 ms cycle). According to the results of the experiments, it is required that the frequency of the rectangular wave is within the range of 20 to 500 Hz (2 to 50 ms cycle). It is preferable that the frequency of the rectangular wave is with in the range of 25 to 100 Hz (1 to 40 ms cycle).

Note that it is considered that the reason that the upper limit of the frequency is 500 Hz (2 ms cycle) is that an energy amount necessary for moving the black particles 26 and the white particles 27 can be supplied if each of the high potential time and the low potential time is not less than 1 ms.

By the driving conditions, a high quality display by which the user does not feel visual stress when updating display can be also provided similarly to the aforementioned embodiment.

Further, during the display retention time th in the aforementioned embodiment, the low potential (L) is input to each of the pixel electrode 35*b*, pixel electrode 35*w*, and the common electrode 37. However, this is not limited. For example, the pixel electrode 35*b*, the pixel electrode 35*w*, and the common electrode 37 are set to a high impedance state. The high impedance state denotes the state where there in no input from the control unit. Also in the state, since no potential difference occurs between each of the pixel electrodes 35*b*, 35*w* and the common electrode 37, display can be retained. Further, since the power source of the control unit can be turned off, the power consumption can be reduced.

Further, according to the embodiment, since the storage device is equipped in the pixel 40, the potential of the pixel electrode 35 can be kept at a constant value during the display update time tx. Accordingly, a display having a uniform contrast can be obtained in which fluctuation of the potential of the pixel electrode 35 is restrained.

Application to Segment Driving Method

Figure 8:
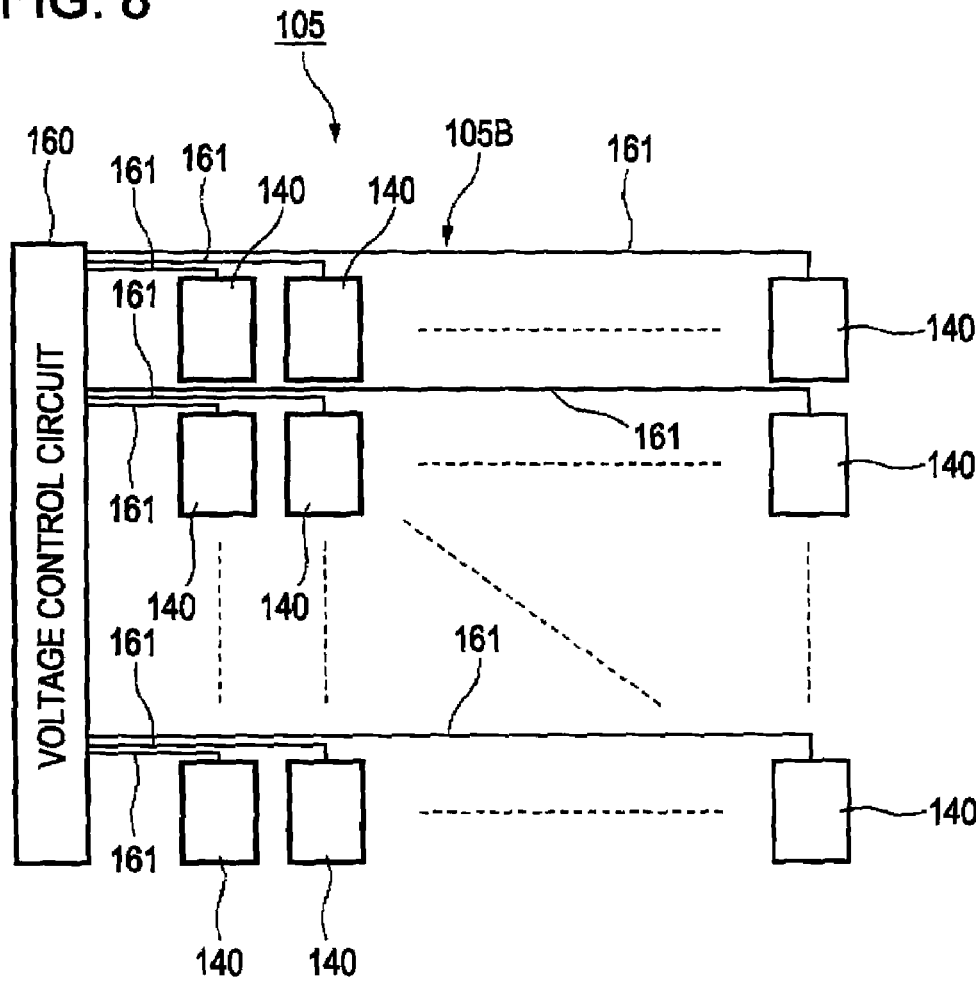
FIG. 8 is a plan view schematically showing an electrophoresis display device.

Note that the invention is also available when applied to a segment driving method. FIG. 8 is a plan view schematically showing an electrophoresis display device 105 of a segment driving method. The electrophoresis display device 105 is equipped with a display area 105B in which a plurality of segments (pixels) 140 are arranged, and a voltage control circuit 160. The voltage control circuit 160 and each segment 140 are electrically connected via a power source drive wire 161.

Figure 9:
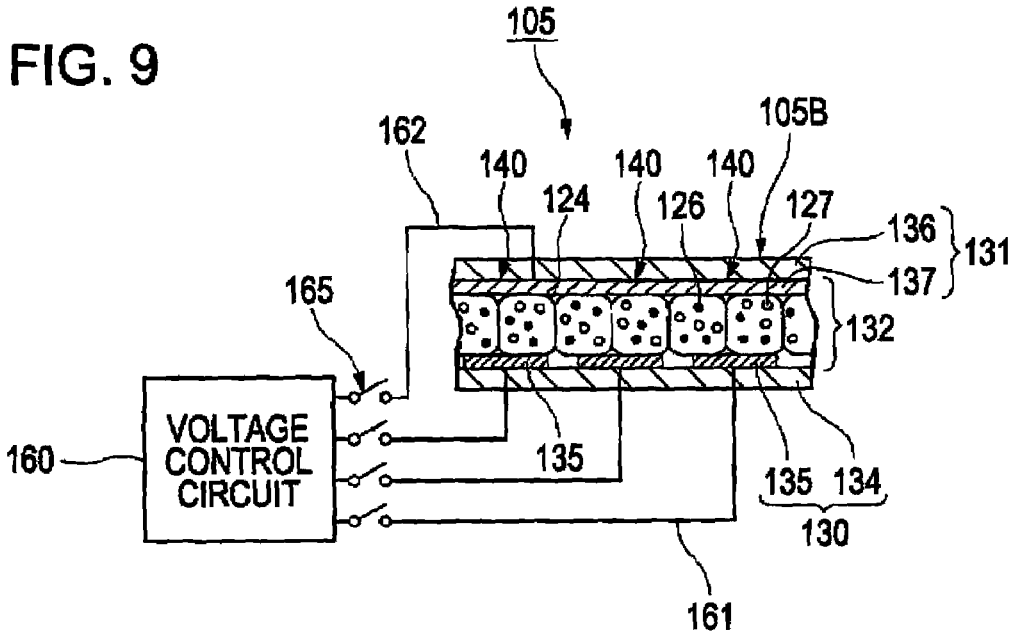
FIG. 9 is a diagram showing a cross sectional structure and an electrical structure of the electrophoresis display device.

FIG. 9 is a diagram showing an electrical structure of the electrophoresis display device 105 with a cross sectional structure. The display area 105B is equipped with an element substrate 134 in which a plurality of segment electrodes (pixel electrodes) 135 are provided for every segment 140, a counter substrate 136 equipped with a common electrode 137 commonly provided to all of the segment electrodes 135, and an electrophoresis element 132 formed by a plurality of microcapsules 124 in which black particles 126 charged to positive polarity and the white particles 127 charged to negative polarity are enclosed.

The electrophoresis element 132 is sandwiched by the segment electrodes 135 and the common electrode 137.

Each segment electrode 135 is electrically connected to a voltage control circuit 160 via the power source drive wire 161 and a switch 165. The come electrode 137 is electrically connected to the voltage control circuit 160 via a common electrode drive wire 162 and the switch 165.

Figure 10:
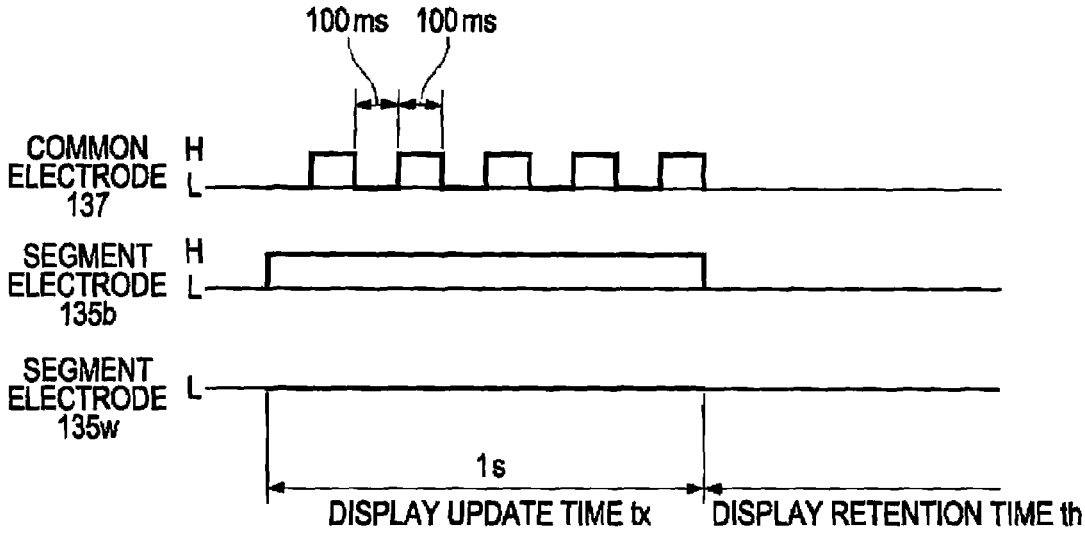
FIG. 10 is a diagram showing a timing chart according to the electrophoresis display device.

FIG. 10 is a diagram showing an example of a timing chart according to the electrophoresis display device 105 of the conventional segment driving method. Herein, the plurality of segments 140 are separated into the segment 140 for displaying black and the segment 140 for displaying white for description.

During the display update time tx, a high voltage (H) is input to a segment electrode 137*b* of the segment 140 that displays black and a low potential (L) is input to a pixel electrode 137*w* of the segment 140 that displays white. Further, a rectangular wave whose cycle is 200 ms that repeats a high potential time of 100 ms and a low potential time of 100 ms is input to the common electrode 137. That is, a rectangular wave whose frequency is 5 Hz (200 ms cycle) is input to the common electrode 137.

Further, the display update time tx is set to 1.0 sec in FIG. 10, so that the rectangular wave whose cycle is 200 ms is repeated for five cycles during the display update time tx.

Figure 11:
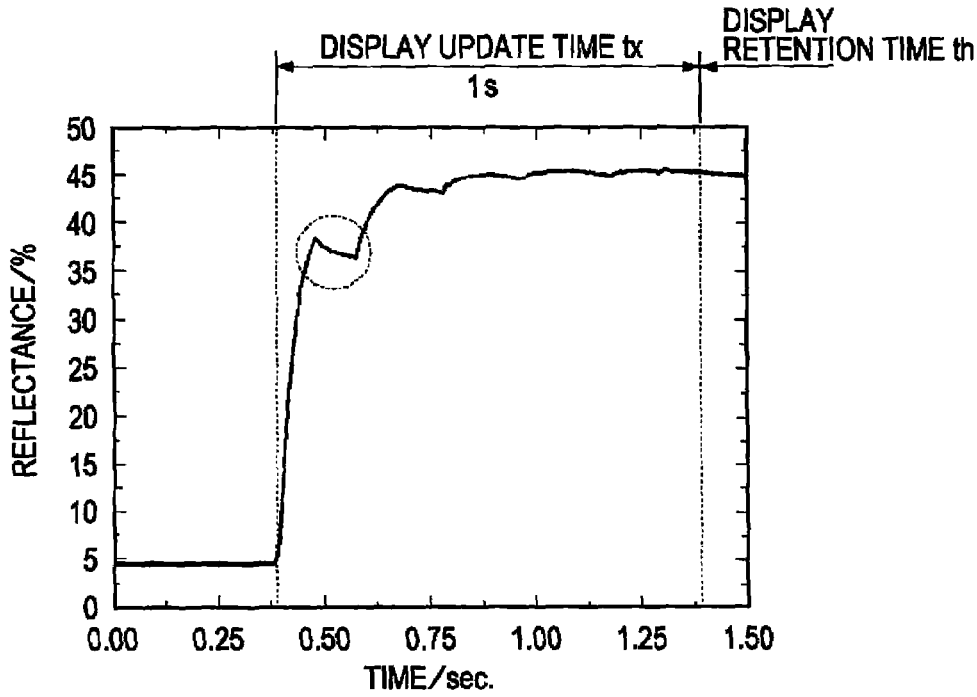
FIG. 11 is a diagram showing a graph in which reflectance is measured in chronological order.

FIG. 11 is a diagram showing a graphs in which the variation of the reflectance in the electrophoresis display device 105 of the conventional segment drive system is measured in chronological order.

In FIG. 11, the horizontal axis shows elapsed time and the high potential (H) is input to the segment electrode 135*b* and the low potential (L) is input to the segment electrode 135*w* during the display update time tx that starts from the timing of about 0.4 second.

Further, a rectangular wave whose cycle is 200 ms (5 Hz) in which the high potential time of 100 ms and the low potential time of 100 ms are repeated is input to the common electrode 137. Thereafter, during the display retention time th, the low potential is input to each of the segment electrodes 135*b*, 135*w*, and the common electrode 137.

Further, the display update time tx is set to 1 sec. That is, in the conventional driving method, a rectangular wave whose cycle is 200 ms is input for five cycles during the display update time tx.

Note that the timing of about 0.4 sec when the display update time tx is started shows a starting point of the measurement and the display retention time th shows a data retention time at the measurement, and there is no other intention in each thereof.

The area surrounded by the ○ in FIG. 11 shows a change of reflectance at the timing when the first cycle of the rectangular wave is applied.

As shown in FIG. 10, since the low potential (L) is applied to both of the common electrode 137 and the segment electrode 135*w* in the segment 140 that displays white at the timing, no potential difference occurs and each electrophoresis particle is supposed to remain in the position. However, as shown in the ○, the reflectance is lowered and a flicker is observed in reality.

Since then, also in the electrophoresis display device 105 of the segment driving method, as is omitted in the drawing, it is confirmed that the period in which lowering of the reflectance occurs can be reduced to not more than one-quarter similarly to FIG. 7 by applying a rectangular wave whose frequency is not less than 20 Hz (not more than 50 ms cycle) to the common electrode 137 for driving.

Note that in the segment driving system, it is also confirmed by experiences that the occurrence of the flicker can be reduced by the frequency of the rectangular wave similar to the embodiment. Accordingly, a high quality display in which flicker is reduced by which the user does not feel visual stress when updating display can be provided also in the segment driving method.

Modifications

Figure 12A:
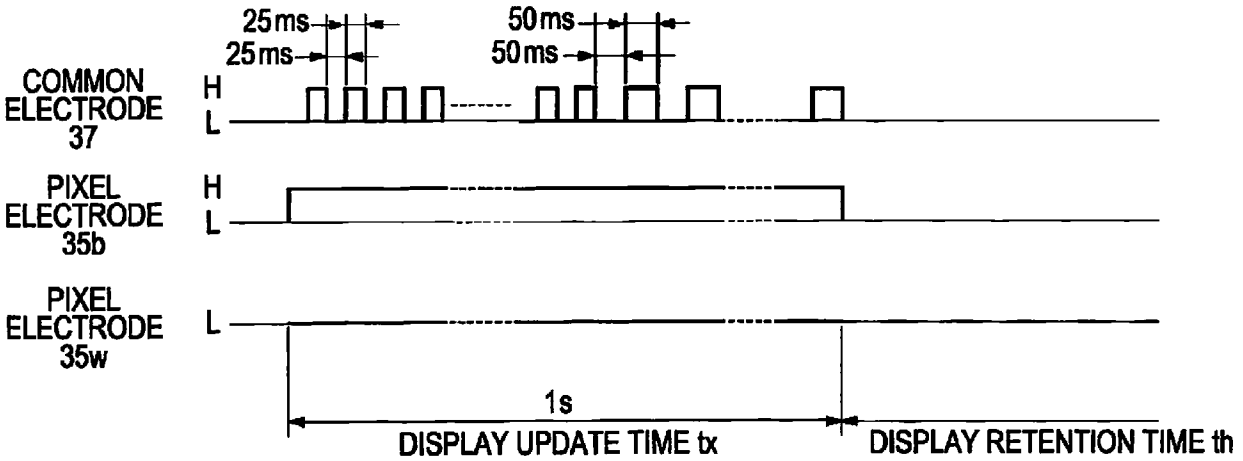
FIGS. 12A and 12B are each a diagram showing a timing chart according to a modification.
Figure 12B:
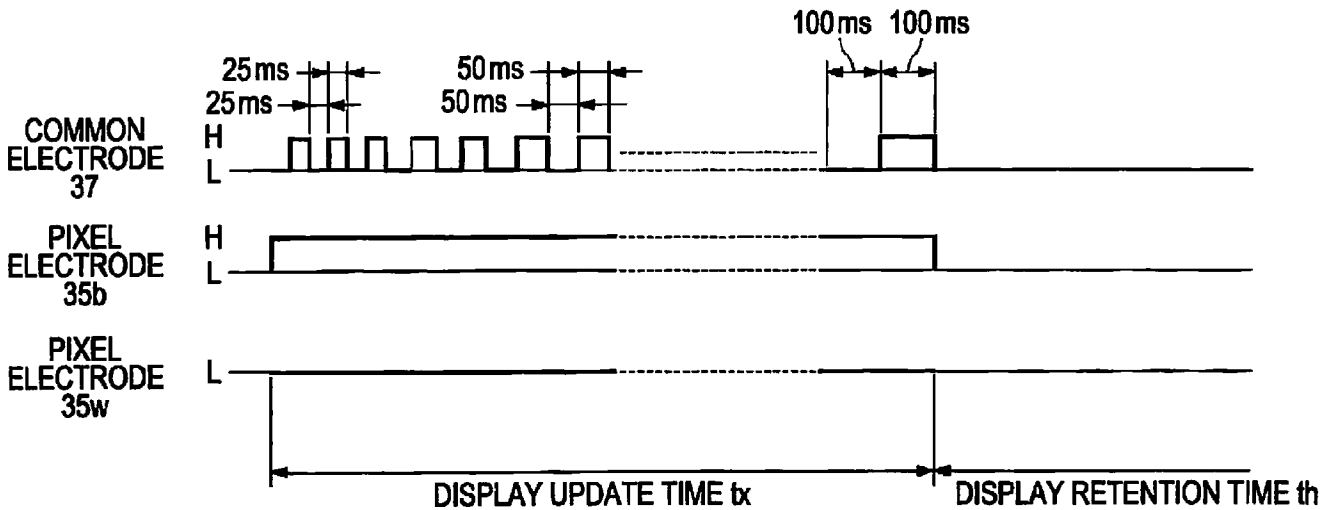

FIGS. 12A, 12B are each a diagram showing a timing chart according to a modification. In the aforementioned embodiment, the rectangular wave having a constant frequency is sequentially applied to the common electrode 37 during the display update time tx. However, this is not limited thereto.

According to the occurrence mode of the flicker in FIG. 18, a flicker of a large size is observed in first and second cycles of the rectangular wave. Consequently, for example, a rectangular wave of 20 Hz may be applied during the first half of the display update time tx (25 cycles of the first half among the 50 cycles in FIG. 18) and a rectangular wave of 10 Hz may be applied during the 25 cycles of the second half to the common electrode 37 (FIG. 12A).

Further, during the display update time tx, the frequency of the rectangular wave may be reduced from 20 Hz, to 10 Hz, 5 Hz in a stepwise manner (FIG. 12B).

That is, the prevention effect of the flicker in the invention can be obtained as long as a rectangular wave whose cycle is not less than 20 Hz is applied at least during the first half of the display update time tx.

Electronic Apparatus

Figure 13:
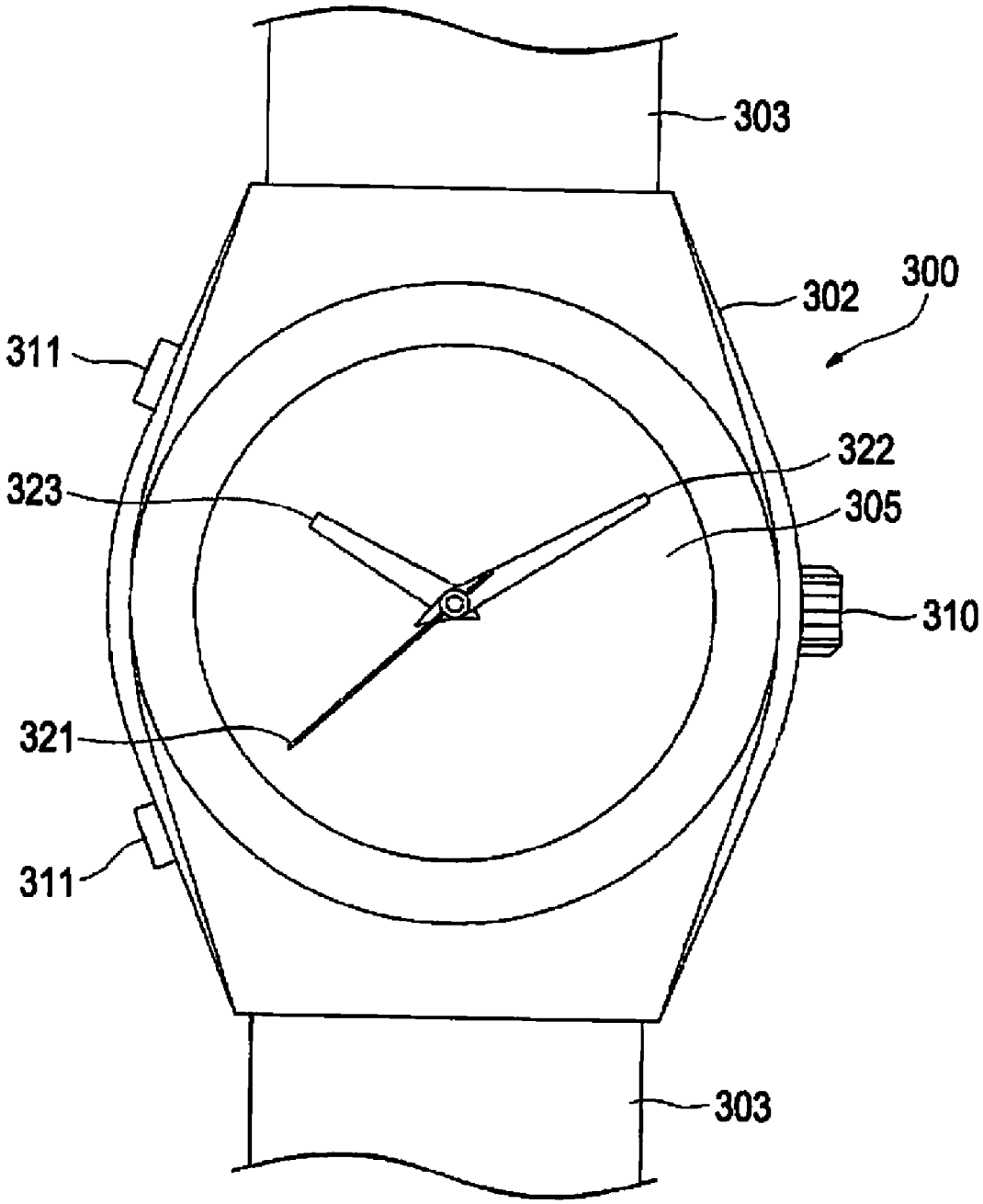
FIG. 13 is a front view showing a watch.

Herein, the case where the electrophoresis display device of the invention is applied to an electronic apparatus will be described. FIG. 13 is a front view of a watch 300. The watch 300 is equipped with a watch case 302, and a pair of bands 303 coupled to the watch case 302.

An electrophoresis display device (display panel) 305, a second hand 321, a minute hand 322, and an hour hand 323 are provided on the front surface of the watch case 302, and a crown 310 and operation buttons 311 as operators are proved at the side surface of the watch case 302. The crown 310 is coupled to a core (omitted in the drawing) provided in the case and provided in an integrated manner (for example, two steps) with the core so as to be pushed and pulled in a multistep manner and so as to be freely rotated.

An image to be a back ground, a character string such as date, hour, or the like, a second hand, a minute hand, an hour hand, or the like can be displayed by the electrophoresis display device 305.

The watch 300 equipped with a display area in which flicker does not outstand and superior in display quality can be provided by equipping the electrophoresis display device of the invention.

Figure 14:
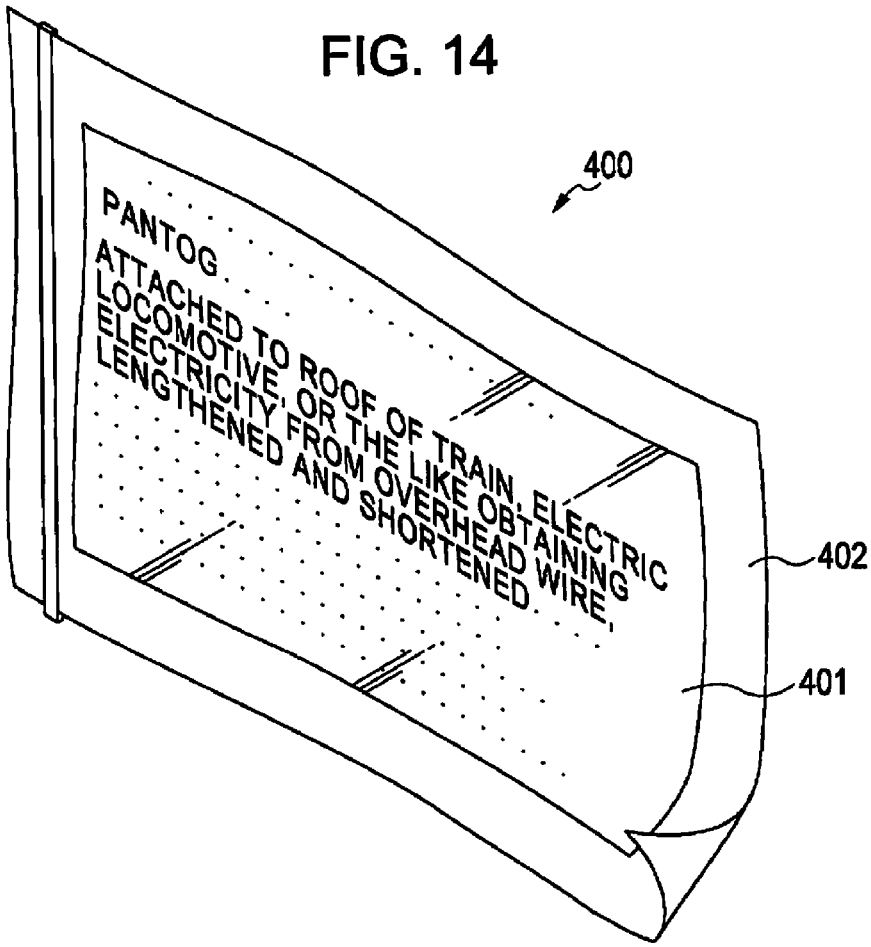
FIG. 14 is a perspective view showing an electronic paper.

FIG. 14 is a perspective view showing a structure of an electronic paper 400. The electronic paper 400 is equipped with the electrophoresis display device of the invention as a display area 401. The electronic paper 400 has a flexibility and is constituted to be equipped with a main body 402 formed by a rewritable sheet having the same texture and flexibility as the conventional paper.

Figure 15:
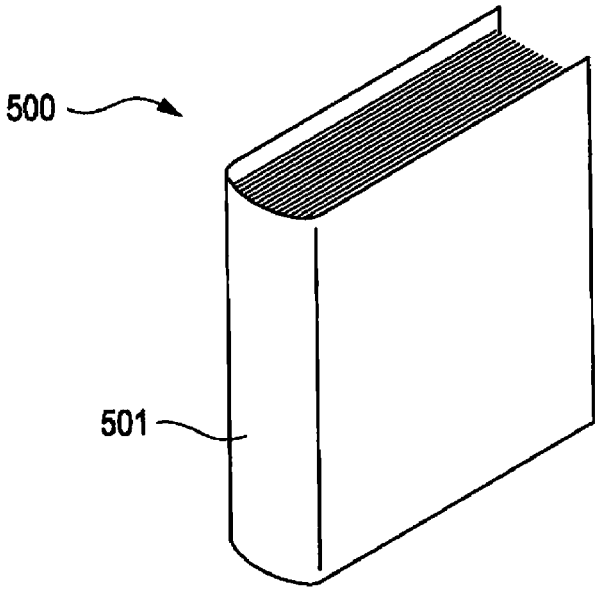
FIG. 15 is a perspective view showing an electronic note.
Figure 16:
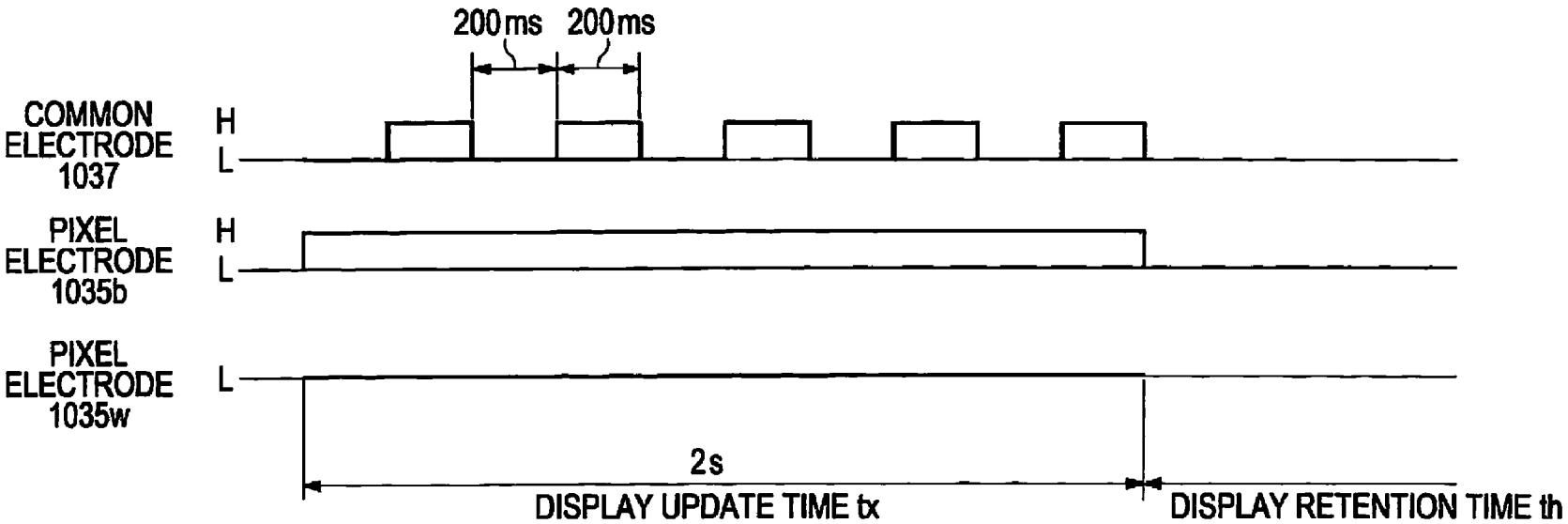
FIG. 16 is a diagram showing an example of a timing chart of a conventional electrophoresis display device.
Figure 17A:
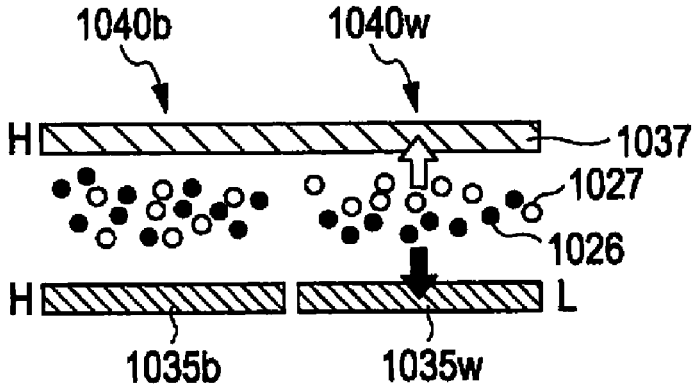
FIGS. 17A to 17C are diagrams showing a behavior of electrophoresis particles.
Figure 17B:
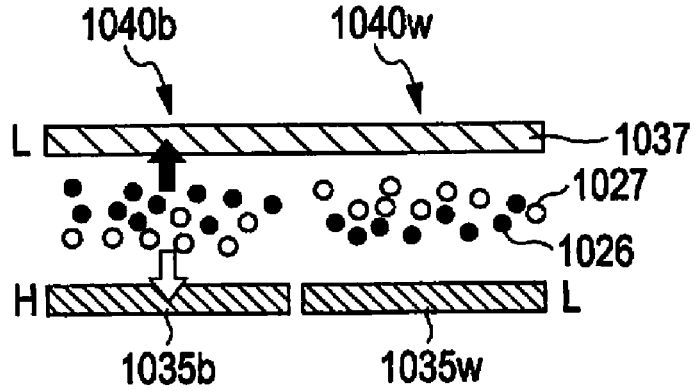
Figure 17C:
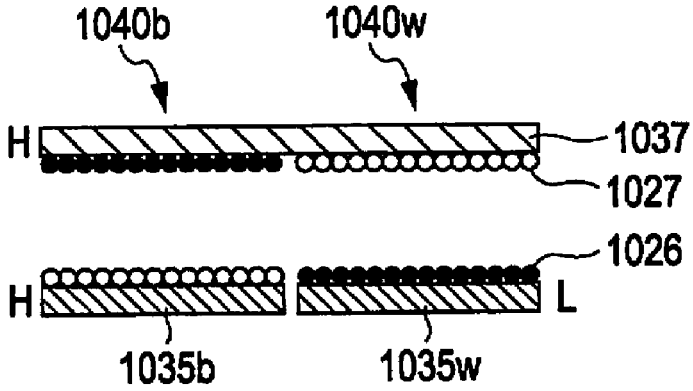

Further, FIG. 15 is a perspective view showing a structure of an electronic note 500. The electronic note 500 is the one in which a plurality of the electronic papers 400 shown in FIG. 14 are bundled and sandwiched by a cover 501. The cover 501 is equipped with display data input means not shown in FIG. 15 for inputting display data transmitted from, for example, an outer device. Herewith, change or update of a content to be displayed can be performed in accordance with the display data in the state where the electronic papers 400 are bundled.

The electronic paper 400 and the electronic note 500 in which flicker does not outstand and equipped with a display area superior in display quality can be provided by equipping the electrophoresis display device of the invention.

The electrophoresis display device of the invention can be used in a display area of an electronic apparatus such as a cell-phone, a potable audio instrument, or the like besides the electronic paper 400 and the electronic note 500.

Herewith, an electronic apparatus in which flicker does not outstand and equipped with a display area superior in display quality can be provided.

The entire disclosure of Japanese Patent Application No. 2007-226474, filed Aug. 31, 2007 is expressly incorporated by reference herein.

What is claimed is:

1. A method for driving an electrophoresis display device equipped with a pixel electrode that is provided for a pixel, a common electrode provided to oppose the pixel electrode, and an electrophoresis element containing electrophoresis particles, the electrophoresis element being sandwiched by the pixel electrode and the common electrode, the method for driving an electrophoresis display device comprising:

driving the electrophoresis element and updating a display by a common voltage swing drive method in which a rectangular wave in which a first potential and a second potential are repeated is applied to the common electrode for not less than one cycle during a display update time in which the first potential or the second potential for moving the electrophoresis particles is applied to the pixel electrode, wherein:

the rectangular wave has a first frequency during a first portion of a display update time period such that the first potential and the second potential are alternately applied to the common electrode a plurality of times according to the first frequency during the first portion of the display update time period, the first frequency of the rectangular wave being not less than 20 Hz;

the rectangular wave has a second frequency during a second portion of the display update time period such that the first potential and the second potential are alternately applied to the common electrode a plurality of times according to the second frequency during the second portion of the display update time period, the second portion of the display update time period being later than the first portion of the display update time period.

2. The method for driving an electrophoresis display device according to claim 1, wherein a period during applying the first potential and a period during applying the second potential in the rectangular wave are not less than 1 ms and not more than 25 ms.

3. The method for driving an electrophoresis display device according to claim 1, wherein a period during applying the first potential and a period during applying the second potential in the rectangular wave are not less than 5 ms and not more than 20 ms.

4. The method for driving an electrophoresis display device according to claim 1, wherein the first frequency differs from the second frequency.

5. The method for driving an electrophoresis display device according to claim 1, wherein the second frequency is less than the first frequency.

6. An electrophoresis display device including at least a pixel electrode that is provided for a pixel, a common electrode provided to oppose the pixel electrode, and an electrophoresis element containing electrophoresis particles, the electrophoresis element being sandwiched by the pixel electrode and the common electrode, wherein driving of the electrophoresis element for updating a display is performed by a common voltage swing drive method in which a rectangular wave in which a first potential and a second potential are repeated is applied to the common electrode for not less than one cycle during a display update time in which the first potential or the second potential for moving the electrophoresis particles is applied to the pixel electrode, and including a control unit for controlling a frequency of the rectangular wave, wherein:

the rectangular wave has a first frequency during a first portion of a display update time period such that the first potential and the second potential are alternately applied to the common electrode a plurality of times according to the first frequency during the first portion of the display update time period, the first frequency of the rectangular wave being controlled so as to be not less than 20 Hz;

the rectangular wave has a second frequency during a second portion of the display update time period such that the first potential and the second potential are alternately applied to the common electrode a plurality of times according to the second frequency during the second portion of the display update time period, the second portion of the display update time period being later than the first portion of the display update time period.

7. The electrophoresis display device according to claim 6, wherein the control unit controls a period during applying the first potential and a period during applying the second potential in the rectangular wave so as to be not less than 1 ms and not more than 25 ms.

8. The electrophoresis display device according to claim 6, wherein the control unit controls a period during applying the first potential and a period during applying the second potential in the rectangular wave so as to be not less than 5 ms and not more than 20 ms.

9. The electrophoresis display device according to claim 6, wherein the pixel is equipped with a pixel circuit, and the control unit employs an active matrix method for controlling the pixel via the pixel circuit.

10. The electrophoresis display device according to claim 9, wherein the pixel circuit is equipped with a storage device.

11. An electronic apparatus comprising the electrophoresis display device according to claim 6.

12. A controller for controlling an electrophoresis display device including at least a plurality of pixel electrodes, each of the pixel electrodes being provided for every pixel, a common electrode provided to oppose the plurality of pixel electrodes, and an electrophoresis element containing electrophoresis particles, the electrophoresis element being sandwiched by the plurality of pixel electrodes and the common electrode, the controller executing a method for driving the electrophoresis display device comprising:

driving the electrophoresis element and updating a display by a common voltage swing drive method in which a rectangular wave in which a first potential and a second potential are repeated is applied to the common electrode for not less than one cycle during a display update time in which the first potential or the second potential for moving the electrophoresis particles is applied to each of the pixel electrodes, wherein:

the rectangular wave has a first frequency during a first portion of a display update time period such that the first potential and the second potential are alternately applied to the common electrode a plurality of times according to the first frequency during the first portion of the display update time period, the first frequency of the rectangular wave being not less than 20 Hz;

the rectangular wave has a second frequency during a second portion of the display update time period such that the first potential and the second potential are alternately applied to the common electrode a plurality of times according to the second frequency during the second portion of the display update time period, the second portion of the display update time period being later than the first portion of the display update time period.

* * * * *